US007002141B2

(12) United States Patent
Ohmukai et al.

(10) Patent No.: US 7,002,141 B2
(45) Date of Patent: Feb. 21, 2006

(54) ATOMIC LITHOGRAPHY APPARATUS USING ELECTRO-OPTIC EFFECT AND METHOD OF MANUFACTURING ATOMIC STRUCTURE

(75) Inventors: Ryuzo Ohmukai, Koganei (JP); Masayoshi Watanabe, Koganei (JP)

(73) Assignee: National Institute of Information and Communications Technology, Incorporated Administrative Agency, Tokyo (JP)

( * ) Notice: Subject to any disclaimer, the term of this patent is extended or adjusted under 35 U.S.C. 154(b) by 36 days.

(21) Appl. No.: 10/776,341

(22) Filed: Feb. 12, 2004

(65) Prior Publication Data

US 2004/0206896 A1 Oct. 21, 2004

(30) Foreign Application Priority Data

Feb. 13, 2003 (JP) ..... 2003-035356

(51) Int. Cl.
*H05H 3/02* (2006.01)

(52) U.S. Cl. ..... 250/251; 250/305; 437/173; 437/80; 437/81; 437/948; 427/561; 427/259

(58) Field of Classification Search ..... 250/251, 250/305; 437/173, 81, 80, 948; 427/561, 427/259

See application file for complete search history.

(56) References Cited

U.S. PATENT DOCUMENTS 5,360,764 A * 11/1994 Celotta et al. ..... 427/596
6,183,817 B1 * 2/2001 Gersonde ..... 427/561
6,787,759 B1 * 9/2004 Saffman ..... 250/251

FOREIGN PATENT DOCUMENTS

JP 2002-075825 3/2002

OTHER PUBLICATIONS

W.Z. Zhao, et al.; Review of Scientific Instruments—"A computer-based digital feedback control of frequency drift of multiple lasers", vol. 69, No. 11, pp. 3737-3740, Nov. 1998.

G. Timp; R.E. Behringer, et al; Physical Review Letters—"Using Light as a Lens for Submicron, Neutral-Atom Lithography", vol. 69, No. 11, 14, pp. 1636-1639, Sep. 1992.

A.S. Bell et al.; Microelectronic Engineering 41/42—"Atomic Lithography", pp. 587-590, 1998.

B. Sheehy, S.-Q. Shang et al.; Chemical Physics 145—"Collimation of rubidium beam below the Doppler limit", pp. 317-325, 1990.

* cited by examiner

*Primary Examiner*—Nikita Wells
*Assistant Examiner*—Zia R. Hashmi
(74) *Attorney, Agent, or Firm*—Westerman, Hattori, Daniels & Adrian, LLP

(57) ABSTRACT

An atomic lithography apparatus for depositing atoms included in an atomic beam on a substrate to manufacture an periodic atomic structure, comprising an atomic oven having a pin hole, a collimator for collimating an atom gas effused from the atomic oven to generate an atomic beam, four lasers for irradiating laser beams on the atomic beam to control the spreading angle of the atomic beam, two lasers for forming an optical standing wave at a part of a space in which the atomic beam is propagated, an electro-optic element for controlling the phases of the optical standing wave for controlling the propagation direction of the atomic beam, an electro-optic element drive device for controlling a voltage applied to the electro-optic element to control a refraction index of the electro-optic element, and a control device for controlling the electro-optic element drive device.

13 Claims, 3 Drawing Sheets

ATOMIC LITHOGRAPHY APPARATUS USING ELECTRO-OPTIC EFFECT AND METHOD OF MANUFACTURING ATOMIC STRUCTURE

BACKGROUND OF THE INVENTION

1. Field of the Invention

The invention relates to a micropattern forming method and an atomic lithography apparatus for forming a pattern on a substrate and, more particularly, to atomic lithography which freely draws a desired periodic pattern on a substrate and which has a high drawing resolution which is a diffraction limit of light or less in a technique (atomic lithography) for controlling movement of atoms or molecules with a laser and depositing the atoms or molecules on a substrate to form a microstructure.

2. Description of the Related Art

A reduction optical lithography system is popularly used in manufacturing a semiconductor integrated circuit with a pattern formed in a sub-micron region. In this method, the following processes are used. That is, a photosensitive resist agent is coated on the surface of an object on which a micropattern is to be formed, the micropattern is formed by using the reduction optical system, and the surface of the object is etched by using the photosensitive resist film as an etching mask. The unnecessary photosensitive resist mask is removed to form a desired micropattern. When the photosensitive resist film is used in this method, a small amount of impurity is diffused on the surface of the object on which the micropattern is to be formed which adversely affects the electronic characteristics of the surface. In another method of drawing a micropattern, not only simultaneous exposure but also drawing using a narrow electronic beam are performed. However, in this method, repulsion (Coulomb interaction) between electrons regulates a drawing resolution in convergence of the electron beam. Since a photosensitive resist agent is also used, there is the same problem as that in the above case.

Recently, a method using interaction between an optical standing wave and electrically neutral atoms has attracted attention (for example, see the following Non-patent Document 1 (G. Timp, et al., "Using light as a Lens for Submicron, Neutral-Atom Lithography", Phys. Rev. Let., 69, 1635–1639, 1992)). The Non-patent Document 1 describes, as can be seen in FIG. 1 in the document, a standing wave having a diameter of about 300 $\mu$m formed by using a laser having a wavelength of 589 nm, and propagated in a direction perpendicular to the direction of an atomic beam having a low average speed of 740 m/s to draw a strip pattern on a substrate, with the results being that the line width of the strip pattern is narrowed.

Non-patent Document 2 (A. S. Bell, et al., "Atomic Lithography", Microelectronic Engineering 41/42, 587–590, 1998) demonstrates in a configuration shown in FIG. 1A of Non-patent Document 2, a standing wave having a grid-like pattern generated by two reflecting plates and a laser having a wavelength of 425 nm, so that a grid point group has a cycle which is ⅔ the wavelength of the beam. A chromium atomic beam is generated and changed into an atomic line with a parallel moving direction by using a laser cooling method, so that a laser has the wavelength which is close to the wavelength at which resonant transition of chromium atoms is caused.

When utilizing a laser which has an uneven laser intensity distribution and a wavelength longer than the resonant transition wavelength of the atoms used, the atoms are subjected to a force such that the atoms are moved toward a region having high laser intensity in the light field. On the contrary, when a laser which has a wavelength shorter than the resonant transition wavelength is used, the atoms are subjected to a force such that the atoms are moved toward a region having small laser intensity. In the above Document 2, by using the characteristics, the pattern is formed on the silicon substrate, and a photosensitive resist agent is not formed. For this reason, the silicon substrate is not easily polluted.

FIG. 1 shows an example of a conventional method of forming a micropattern (see the following Patent Document 1 (Japanese Patent Application Laid-Open No. 2002-75825)).

FIG. 1 is a pattern diagram showing an example of conventional atomic lithography performed in a vacuum chamber 100. A material used in the lithography is put in an oven 10 to heat and evaporate the material. This evaporated gas is collimated by using two pin holes (the first pin hole is in the oven, and the second pin hole is in a collimator 2) arranged coaxially in the direction in which the evaporated atoms scatter. A group of atoms treated in this manner generate a thermal atomic beam.

Since the thermal atoms have various speeds, the atoms are moderated by the well known scattering force of the beam or sorted depending on the speeds, so that the atoms are moderated to have a speed of, e.g., 5 m/s or less.

A magneto-optical trap (MOT) captures the moderated atomic beam obtained as described above. At the same time, a laser cooling operation is performed to cool the atoms such that the kinetic energy becomes energy corresponding to a temperature of 1 mK or less. The MOT is constituted by an AntiHelmholtz coil 5 and a laser 6. The AntiHelmholtz coil 5 may be arranged either on the outside or the inside of the vacuum chamber. Further, a current is flowed into the coil such that a magnetic gradient generated by the coil is about 1 mT/cm. The MOT laser is caused to be incident in six directions (±x, ±y, ±z) from the outside of the vacuum chamber through a view port.

When the group of atoms are captured by the MOT and sufficiently cooled, irradiation of the laser used in the MOT is interrupted, and a group of cooled atoms 3 is caused to free-fall by about 10 cm according to gravitational force. To control the kinetic energy of the atoms, the distance is controlled. At this time, the cooled atoms are arranged to fall vertical in the direction of gravity.

The quadrupole magnetic field generated at this time is generated as follows. That is, four copper rods 4 (length of 10 cm) are arranged at equal intervals (10 mm) as shown in FIG. 1, and currents opposite to each other are flowed into the rods to generate a magnetic field (maximum magnetic field=15 mT) (magnetic gradient of 30 mT/cm), and the falling cooled atoms are prevented from being scattered in a lateral direction (direction in a plane vertical to the falling direction), so that a magnetic trap for increasing the density of atoms is achieved.

In addition, laser light, 8 is directed through a view port, 9 in conjunction with a solenoid coil, 7 for Zeeman Alignment Moderation. Incidence laser light, 19 and outgoing radiation laser light, 20 are also directed through view ports, 9 in proximity to the substrate, 1.

A hologram (light transmittance) is formed by calculation from a two-dimensional space pattern which is desirably drawn on the substrate 1.

In the conventional method of forming a micropattern, as described in Non-patent Document 1 and Non-patent Document 2, striped and grid-like patterns are realized.

However, since a standing wave is used in these techniques, even though the point will be modified in the future, only a simple graphic such as a polygon can be drawn.

SUMMARY OF THE INVENTION

Figure 1:
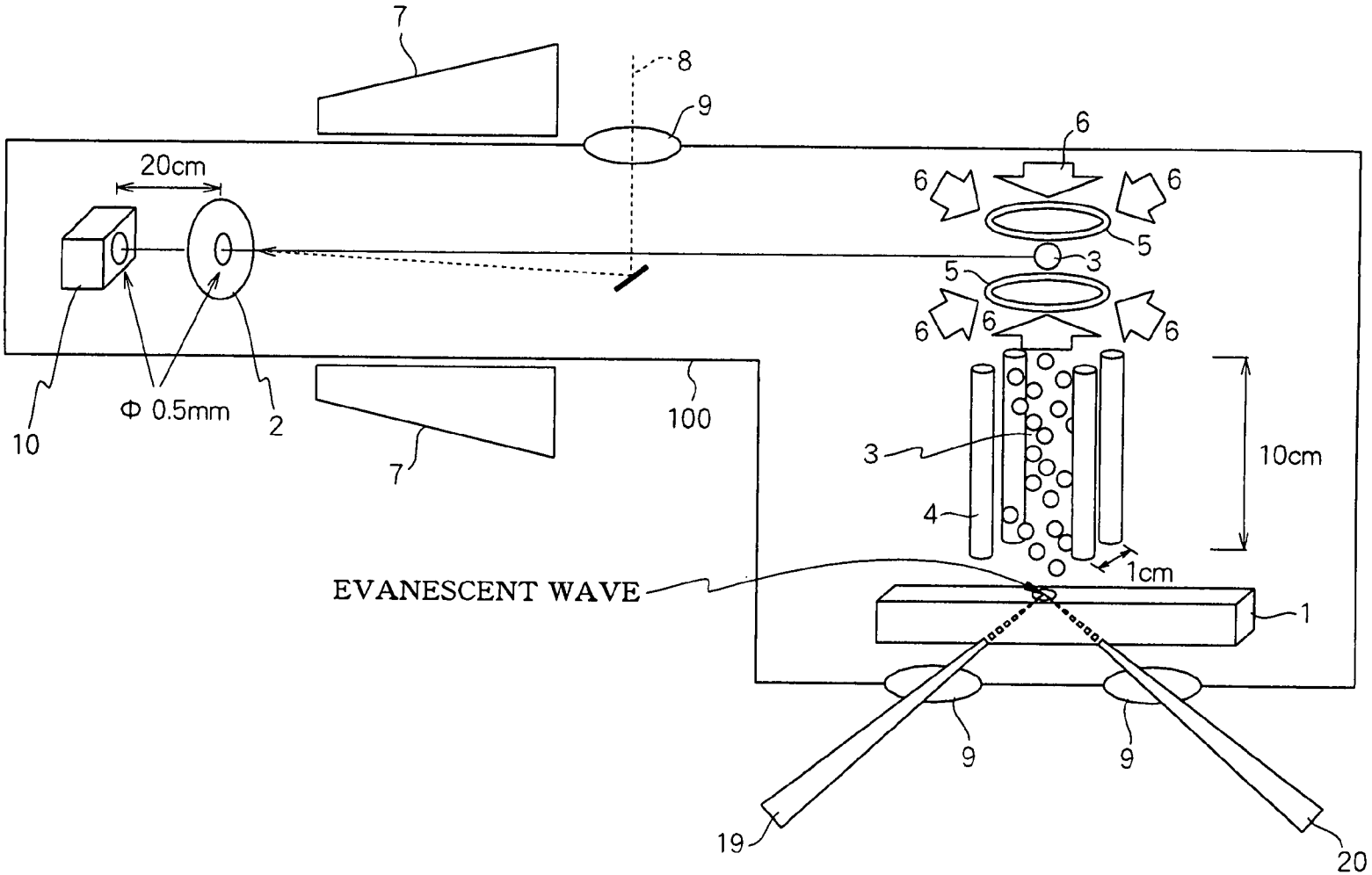
FIG. 1 is a schematic diagram showing an example of a conventional method of forming a micropattern.

The present invention has been proposed in consideration of the above circumstances, and has as its object to provide an atomic lithography technique which uses interaction between light and atoms as in the above conventional method and which has a high resolution of the diffraction limit of light or less, and a method of forming a periodic micropattern which can simultaneously free pattern.

At least one of the above-noted problems is solved by the following invention.

(1) According to the first aspect of the present invention, there is provided an atomic lithography apparatus for depositing atoms included in an atomic beam on a substrate to manufacture an atomic structure, including: an atomic oven having a pin hole; a collimator having a pin hole for collimating an atom gas discharged from the atomic oven to generate an atomic beam; lasers for irradiating laser beams on the atomic beam to control the divergence of the atomic beam; lasers for forming an optical standing wave at a part of the space in which the atomic beam is propagated and thus control the propagation direction of the atomic beam; an electro-optic element for controlling the phases of the optical standing wave for controlling the propagation direction of the atomic beam and thus control the propagation direction of the atomic beam; an electro-optic element drive device for controlling a voltage applied to the electro-optic element to control a refraction index of the electro-optic element; and a control device for controlling the electro-optic element drive device.

(2) According to the first aspect of the present invention, the atomic lithography apparatus preferably includes a shutter for blocking the atomic beam.

(3) According to the first aspect of the present invention, the laser beams for controlling the propagation direction of the atomic beam are constituted by laser beams which are perpendicular to the propagation direction of the atomic beam, and in instances where two laser beams are utilized the laser beams are orthogonally arranged.

(4) According to the second aspect of the present invention, there is provided a method of manufacturing an atomic structure on a substrate including: the atomic beam generation step of generating an atomic beam; and the step of controlling an optical standing wave obtained by a laser by using an electro-optic effect to control the propagation direction of the atomic beam.

(5) According to the second aspect of the present invention, the atomic beam generation step preferably includes the atom gas generation step of evaporating atoms by an atomic oven; and the atomic beam acquisition step of propagating the atom gas through one pin hole or two or more pin holes to collimate the atom gas and irradiating the laser beams on the collimated atom gas to set the divergence of the atom gas at not more than 1 mrad.

(6) According to the second aspect of the present invention, two laser beams which are orthogonal and perpendicular to the propagation direction of the atomic beam are prepared, the optical standing wave is obtained by the two laser beams passing through the electro-optic element, and, by controlling the refraction index of the electro-optic element, the propagation direction of the atomic beam is controlled by changing the phase of the optical standing wave.

(7) According to the third aspect of the present invention, there is provided an atomic lithography apparatus comprising: an atomic beam generation means for generating an atomic beam consisting of gaseous atoms; four lasers for irradiating laser beams on the atomic beam generated by the atomic beam generation means to control the divergence of the atomic beam; two lasers for forming an optical standing wave at a part of a space in which the atomic beam is propagated to control the propagation direction of the atomic beam; an electro-optic element for controlling the phases of the lasers for controlling the propagation direction of the atomic beam to control the propagation direction of the atomic beam; an electro-optic element drive device for controlling a voltage applied to the electro-optic element to control a refraction index of the electro-optic element; and a control device for controlling the electro-optic element drive device.

DETAILED DESCRIPTION OF THE INVENTION

Embodiments of the present invention will be described below with reference to the accompanying drawings. The first embodiment will be explained based on FIG. 2.

Figure 2:
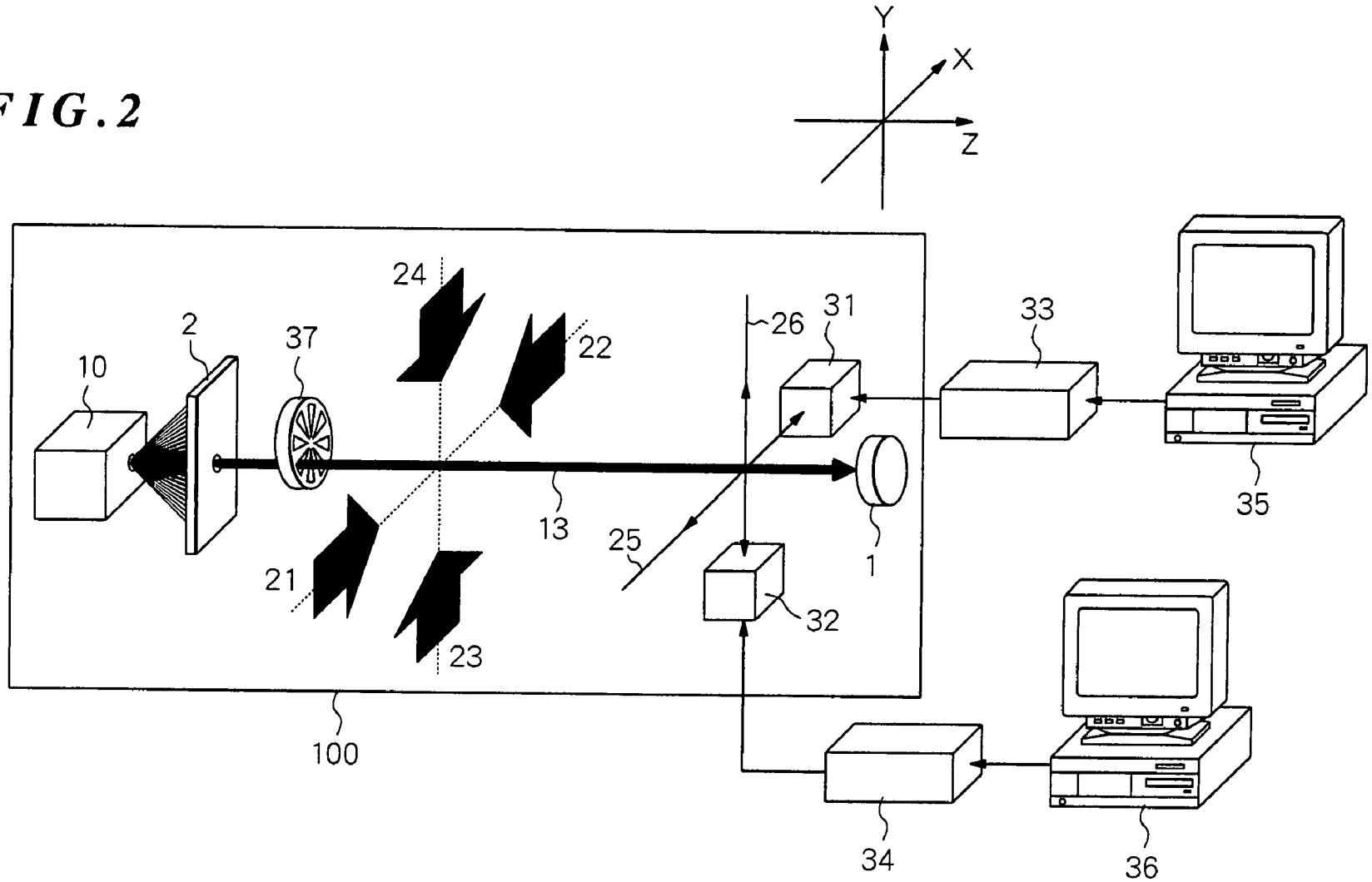
FIG. 2 is a schematic diagram showing an example of an atomic lithography apparatus according to the present invention.

FIG. 2 is a pattern diagram showing the outline of an atomic lithography according to the present invention performed in a vacuum chamber 100. An atomic pattern forming apparatus according to the embodiment of the present invention is a means for generating an atom gas. The atomic pattern forming apparatus comprises a collimator 2, having a pin hole, for collimating the atom gas effused from the atomic oven 10 to generate an atomic beam, atomic beam generation means consisting of laser beams 21 to 24 for controlling the atomic beam, laser beams 25 and 26 for controlling the propagation direction of the atomic beam, electro-optic elements 31 and 32 for controlling the phases of the lasers for controlling the propagation direction of the atomic beam to control the propagation direction of the atomic beam, electro-optic element drive devices 33 and 34 for controlling a voltage or the like applied to the electro-optic elements, and control devices 35 and 36 such as computers for controlling the electro-optic element drive devices. The atom gas effused from the atomic oven 10 is deposited on a substrate 1, and an atomic pattern is drawn.

(Vacuum Chamber)

As the vacuum chamber 100, a known chamber can be used. As a degree of vacuum in the vacuum chamber, a high degree of vacuum or a super-high degree of vacuum is preferable. For example, the vacuum is preferably set at $1.0\times10^{-8}$ Pa or less.

(Atomic Oven)

The atomic oven 10 is not limited to a specific atomic oven. Any atomic oven which can maintain a temperature and a vapor pressure high enough to generate a thermal atomic beam of atoms through a pin hole can be used.

(Pin Hole)

As a pin hole of the collimator 2, any pin hole which can collimate an atom gas effused from the atomic oven 10 can be used. The diameter of the pin hole of the collimator is preferably 1 mm or less, more preferably about 0.5 mm.

(Laser)

As a laser used in the present invention, for example, a solid-state laser, a semiconductor laser, (LD), a liquid laser (dye laser), and a gas laser can be generally used.

As the solid-state laser, a ruby laser (wavelength: 690 nm), a glass laser (wavelength: 1060 nm), a YAG laser (wavelength: 1064 nm), a titanium sapphire laser (wavelength: 700 to 1000 nm), and secondary, tertiary, and quaternary harmonic waves thereof are generally used.

As the semiconductor laser, various lasers based on gallium arsenide, indium gallium arsenide, indium gallium arsenide phosphide, and the like can be generally used.

As the dye laser, various dye lasers can be generally used.

As the gas laser, an He—Ne laser (632.8 nm), an argon laser (510 nm), a fluorine-argon excimer laser (193 nm), a fluorine-krypton excimer laser (249 nm), a fluorine-krypton excimer laser (351 nm), a chlorine-argon excimer laser (175 nm), a chlorine-krypton excimer laser (222 nm), a chlorine-xenon excimer laser (308 nm), a bromine-xenon excimer laser (282 nm), and the like can be generally used. As the gas laser, for example, an argon ion laser is preferably used.

In the present invention, one of these lasers can be used, or a combination of two or more of these lasers can also be used. The gas laser, the dye laser, and the solid-state laser can be independently used, and a combination of the gas laser and the dye laser can be used. Of the lasers as described above, a laser which performs a continuous oscillation operation at a single frequency is preferably used in practice.

However, of these lasers, as a laser to be actually used, a laser having performance which is most suitable for drawing of a pattern having desired characteristics is selected such that the characteristics (oscillation wavelength characteristics, oscillation spectral characteristics, and an optical output power value) and the like of the respective lasers are totally examined.

As the intensities of the laser beams 21 to 24, 1 mW or more is desired as an output value.

As the frequency of the laser beams 21 to 24, the frequency is required to perform laser cooling to atoms. In general, laser cooling is performed by using transition between energy levels of atoms to be controlled. For example, according to the contents of a document ("Laser Cooling of Atoms and Its Peripheral Technique" Shimizu Fujio (OYO BUTURI (Applied Physics) Vol. 60, No. 9, pp. 864 to 874, 1991), transition (laser cooling transition) which can apply the laser cooling to atoms to be actually controlled can be determined. It is desired that the frequencies of the laser beams 21 to 24 can be freely tuned within about several tens MHz with a central focus on a frequency which is resonant with the laser cooling transition.

(Laser for Controlling Atomic Beam)

The intensities of the four laser beams 21 to 24 are about the saturation intensity of the laser cooling transition of at least the atoms constituting the atomic beam, and are preferably set at the saturation intensity or more. The interaction lengths between the four laser beams 21 to 24 are at least 1 cm or more. The frequencies of the laser beams 21 to 24 are negatively detuned from the resonant frequency of the laser cooling transition of atoms by the natural width (half at half maximum) of the transition. For example, when Cr is selected as the atom, a laser having a wavelength of about 425 nm is negatively detuned by about 5 MHz with respect to the frequency. In this state, the frequency of the laser beam is desirably stabilized by using a method described in the document to W. Z. Zhao et al., Rev. Sci. Instrum. 69 (1998) pp. 3737–3740. These four lasers are preferably set such that the laser beams are irradiated on the same plane at angular intervals of 90°.

(Laser for Controlling Propagation Direction of Atomic Beam)

As the power values of the laser beams 25 and 26 for controlling the propagation direction of the atomic beam, at least 10 mW or more is preferable, and a larger value is more preferable. Since the frequencies of the laser beams 25 and 26 determine the cycle of the pattern formed on the substrate, a value depending on an actual application is prepared by appropriate selection of a laser device. The two laser beams are set such that the laser beams irradiate on the same plane at angular intervals of 90°. The frequencies of the laser beams are desirably stabilized by using a method described in the document to W. Z. Zhao et al., Rev. Sci. Instrum., 69 (1998) pp. 3737–3740.

(Electro-optic Element)

As the electro-optic elements 31 and 32, any electro-optic elements which can control the phases of the laser beams 25 and 26 for controlling the propagation direction of the atomic beam to control the propagation direction of the atomic beam can be used. However, a material which has the light transmittance set as high as possible at the wavelengths of the laser beams used is selected, and the light transmittance is desirably set at 95% or more. As the electro-optic elements 31 and 32, elements which achieve electro-optic effects such as Pockels effect and Kerr effect are cited. The electro-optic effect means an effect that the refraction index of a material is changed by the operation of an electric field. The electro-optic effect obtained when the change in refraction index is proportional to the electric field is called Pockels effect. The electro-optic effect obtained when the change in refraction index is proportional to the square of the magnetic field is called Kerr effect. For example, electro-optic elements which achieve Kerr effect is a Kerr cell using liquid nitrobenzene. For example, electro-optic elements which achieve Pockels effect, would be crystals of ADP or KDP.

As the electro-optic elements 31 and 32, for example, Model 4002® (available from New Focus Inc. (U.S.A) can be used.

(Electro-optic Element Drive Device)

An electro-optic element drive device is used to cause a desired change in the refraction index of the electro-optic element, by supplying a necessary voltage to the electro-optic element. As the electro-optic element drive device, a known electro-optic element drive device can be used. However, the device preferably has a function which can control an output voltage value by an input of an external signal. When the device does not have such a function, new electric circuits are preferably added to the device so it has the same function as described above. As the electro-optic element drive devices 33 and 34, for example, a combination of a commercially available function generator (FG273A available from Kenwood Corporation) and an amplifier (SVR1000 available from Piezomechanic GmbH, GERMANY) can be used. In order to perform patterning for a complex pattern, a signal obtained by converting a digital signal from a computer into an analog signal by a commercially available D/A converter and then amplifying the analog signal by the above amplifier can also be used.

(Control Device)

As the control devices 35 and 36, any control devices which can control the electro-optic elements can be used. For example, known computers or the like can be used for the control device. In FIG. 2, although the control devices 35 and 36 are independently arranged, one control device may function as the control devices 35 and 36 in FIG. 2 depending on the capability of the control device.

(Method of Manufacturing Atomic Structure)

A method of drawing an atomic structure (method of manufacturing an atomic structure) on a substrate by using the atomic lithography apparatus according to the present invention will be described below.

The atomic structure means an aggregation of atoms (molecules) which is deposited on a substrate and which has a specific structure.

A material subjected to drawing "to be patterned on the substrate" is put in the atomic oven 10 and then heated to evaporate the material. A heating evaporation device such as Knudsen cell or the like is generally used. As the material, Cr, Al, In, Si, or the like is used. For example, as the temperature of heating, the material may be heated to a temperature such that the vapor pressure of the material is 0.1 Torr or more. Depending on a generation rate of the structure deposited on the substrate 1, conditions such as the temperature of heating, the time of heating, and the like may be determined.

An atom gas effused from the pin hole (not shown) of the atomic oven 10 is transmitted through the pin hole of the collimator 2 to use the atom gas effused from the pin hole as an atomic beam of an atom source for atomic drawing. The pin holes of the atomic oven and the collimator 2 are arranged coaxially with a direction in which the evaporated atoms are scattered. The atom gas is collimated by the two pin holes. It is minimally required that the diameters and interval of the two pin holes formed in the atomic oven and the collimator are set such that the divergence of the atomic beam is 10 mrad or less. The divergence is more preferably about 5 mrad. In order to realize the characteristics, the diameters of the two pin holes are set at 0.5 mm, and the interval between the pin holes is set at 20 cm.

A shutter for blocking the atomic beam is used to regulate time of atomic drawing. The shutter can control the height of an atomic structure generated on the substrate or the concentration of irradiated atoms in the parent structure.

The location for the shutter in not limited. Preferable locations for the shutter may be before the collimator, 2, before or after laser lights, 21–24 and before the substrate, 1.

In the above example, the atomic beam is formed by using a thermal atomic beam. However, it is another embodiment of the present invention that an atomic beam is formed by means for generating an atomic beam consisting of gaseous atoms such as ablation using a YAG laser beam.

The divergence of the atomic beam is controlled by the four laser beams 21 to 24 such that the divergence is smaller than the value achieved as described above. As a control method to be used, a method using optical molasses is used as generally known (For example, B. Sheehy, S. Q. Shang, P. van der Straten, H. Metcalf; Chem. Phys. 145 (1990) 317–325).

The divergence of the atomic beam controlled by the laser beams 21 to 24 is preferably 1 mrad or less, and, more preferably 500 $\mu$rad or less. It is most preferable that the temperature from the kinetic energy in a lateral direction, vertical direction to the propagation direction of the atomic beam, can be suppressed to a Doppler cooling limit temperature. The laser beam intensities, the laser beam frequencies, and the interaction lengths of optical molasses of the laser beams 21 to 24 are accurately regulated to each other such that the Doppler cooling limit temperature can be achieved.

A collimated atomic beam obtained as described above is controlled in propagation direction by the field of an optical standing wave obtained by the laser beams 25 and 26.

Both the laser beams 25 and 26 are reciprocated in x- and y-directions through the electro-optic elements 31 and 32 to form an optical standing wave. One end face (sides far from a position where the atomic beam and the laser beams interact) of each of the electro-optic devices 31 and 32 is preferably coated such that the reflectances of 99% or more can be achieved at the wavelengths of the laser beams 25 and 26. The other end face (sides close to the position where the atomic beam and the laser beams interact) are preferably subjected to antireflect coating at the wavelengths of the laser beams 25 and 26. The reason why the propagation direction of the atomic beam is controlled will be described below.

In a space in which an optical standing wave exists, an optical intensity spatially changes in a cycle which is half the wavelength held by the beam. When an atomic beam is guided into the space, the atomic beam is subjected to force such that the atoms are moved toward a position having a high optical intensity (antinode) or a position having a low optical intensity (node). The atoms of the atomic beam receive optical dipole force made toward the node when the frequencies of the laser beams are positively detuned with respect to the resonant frequency of optical transition of the atoms. In contrast to this, the frequencies are negatively detuned, the atoms receive optical dipole force made toward the antinode. Therefore, the atoms in the atomic beam are collected at the node or antinode of the optical standing wave depending on the sign of optical detuning while the atomic beam passes through the optical standing wave, and the roughness/denseness of the atoms are spatially at a half-wavelength cycle. The frequency of a beam can be detuned with reference to a transition frequency between energy levels held by atom seeds constituting the atomic beam. Depending on the quantity of frequency detuning, the cycle of the atomic pattern to be generated can be changed. In contrast to this, the frequency of the atomic pattern is determined, and the laser frequency may be determined, by a wavelength corresponding to twice the frequency of the atomic pattern. For example, in order to obtain a cyclic structure having a cycle of 200 nm, a laser beam having a wavelength of 400 nm may be used. The value of the quantity of frequency detuning can be desirably set within the range of the frequency dependence of the optical dipole force+500 MHz to the frequency dependence+300 GHz. On the other hand, since the value of dipole force potential also changes depending on frequency detuning, the quantity of frequency detuning is preferably controlled depending on applications. As the laser beams 25 and 26, laser beams having narrow oscillation spectral line widths must be used. The laser beams require at least spectral line widths of 10 MHz or less. For this purpose, as a laser beam source, a laser which performs continuous-wave (cw) and single-frequency oscillation operation is used.

The optical intensities, the beam diameters, and the quantities of frequency detuning of the laser beams 25 and 26 are preferably equal to each other, respectively. These values are preferably controlled such that an atomic structure can be drawn on the substrate at the maximum resolution of the atomic lithography. The optical intensities and the quantities of frequency detuning of the laser beams 25 and 26 are set such that the dipole potential value obtained when the generated optical standing wave acts on the atoms in the atomic beam is larger than the kinetic energy of the atoms after collimation in the x- and y-directions (directions vertical to the propagation direction of the atoms), i.e., the following equation 1 is satisfied.

$$\frac{1}{2}\cdot m\cdot v^2 < \frac{1}{2}\cdot \hbar\cdot\Delta\cdot\ln\left(1+\frac{I}{I_o}\cdot\frac{\tilde{A}^2}{\tilde{A}^2+4\Delta^2}\right) \quad \text{Equation 1}$$

where m is mass of atom, v is lateral speed of atom collimated by the laser beams 21 to 24, Δ is absolute value of quantity of frequency detuning, I is intensity of optical standing wave, $I_0$ is saturation intensity of optical transition serving as a reference for detuning, and Γ is the natural width of the transition.

In this manner, when the wavelengths of the laser beams 25 and 26 are represented by λ, dots are formed in a cycle of λ/2 on the substrate 1 (for example, see A. S. Bell, et al., "Atomic Lithography", Microelectronic Engineering 41/42, 587–590, 1998 (Non-patent Document 2)). A distance between the substrate and a region in which the laser beams 25 and 26 interact with the atoms should be calculated in advance for the drawing resolution of the structure generated on the substrate to be highest. The distance is preferably set at the calculated value.

Voltages are applied to the electro-optic elements 31 and 32 to change the refraction indexes, thereby controlling the position of the node (or antinode) of the optical standing wave.

Since the length of the electro-optic element is constant, when the refraction index of the electro-optic element changes, the phase of a laser beam emitted from the electro-optic element is changed. In this manner, the position of the node (or antinode) of the optical standing wave is shifted, hence, the propagation direction of the optical beam changes. Therefore, when voltages applied to the electro-optic elements 31 and 32 are controlled, the positions of the dots formed on the substrate 1 can be controlled. For this reason, the drawing pattern of the atomic structure deposited on the substrate 1 can be controlled. For example, when a KDP crystal is used as the electro-optic element 31, the refraction index ($n_0$) of the KDP crystal is 1.5 when no voltage is applied to the electro-optic element 31. However, when a voltage is applied to the electro-optic element 31, a change in refraction index is given by the following equation 2.

$$n = n_0 - \frac{no^3}{2}\cdot r\cdot E \quad \text{Equation 2}$$

where r is the specific constant of the material. It is known that the value for KDP crystal is $10.6\times10^{-12}$ (m/V) when used. Reference symbol E denotes an intensity of an electric field generated in the electro-optic element by voltage application.

When the length of the electro-optic element 31 is represented by L, with respect to an optical standing wave generated on the outside (vacuum side) of the electro-optic element 31, the phase of the optical standing wave when voltage is applied changes depending on the following equation 3 in comparison with a phase obtained when no voltage is applied.

$$\Delta\varphi = \frac{no^3}{2}\cdot r\cdot E\cdot\frac{2\pi}{\lambda}\cdot L \quad \text{Equation 3}$$

Therefore, when the applied voltage is controlled, a change in phase can be generated depending on the applied voltage. When the change in phase given by equation 3 is π, the upper limit (Vu) of the applied voltage is given by the following equation 4.

$$V_o = E\cdot L = \frac{\lambda}{no^3\cdot r} \quad \text{Equation 4}$$

In this voltage application, the position of the node (or antinode) of the optical standing wave moves by a distance which is half the wavelength. When the length of the KDP crystal is 10 mm, and when the use wavelength is 400 nm, the applied voltage upper limit (Vu) given by Equation 4 is 5.9 kV.

Figure 3:
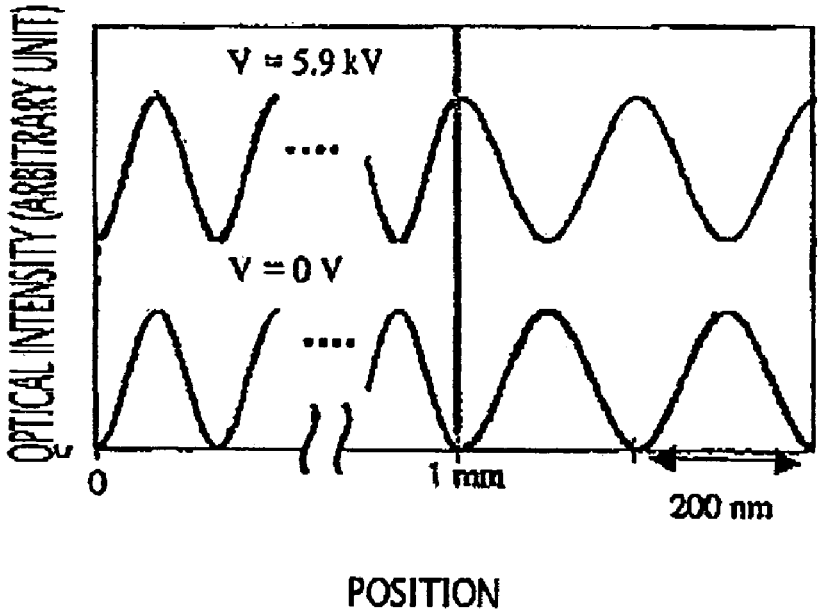
FIG. 3 is a chart showing a manner of a change in position of a node (antinode) of an optical standing wave in an x-direction depending on a voltage applied to a KDP used as an electro-optic element (length 1 mm) with a beam having a wavelength of 400 nm.

FIG. 3 shows a result obtained by calculating an intensity distribution of an optical standing wave generated inside or outside the KDP crystal (length: 10 mm) when the applied voltages are 0 V and 5.9 V. In this case, x=0 is set on the element end face (full-reflection surface), and a refraction index is 1 outside the element. The positions of the nodes (or antinodes) of the standing wave simultaneously change by equal distances outside the element (in vacuum state) by applying a voltage to the electro-optic element. Since the changes of the positions follow the voltage applied to the electro-optic element, the change speed can be controlled within a wide speed range of a low speed (approximately stop) to a high speed (approximately the velocity of light). For example, under the conditions under which the dots are formed at the positions of the nodes of the optical standing wave on the substrate 1, when the voltage applied to the electro-optic element 31 in FIG. 2 is continuously changed more slowly than the deposition rate of the atoms, the positions of the nodes slowly move in the x-direction. Therefore, accordingly, the positions where the dots are formed shift in the x-direction. Meanwhile, the atoms are supplied and continuously deposited. Therefore, as a result, a line having a length depending on the amount of movement is drawn in the x-direction on the substrate 1. When the voltage applied to the electro-optic element 31 is step-wisely changed in comparison with the deposition rate of the atoms, the positions where the dots are formed sharply change. For this reason, two dots spaced at an interval depending on the amount of movement are drawn in the x-direction on the substrate 1. When the two methods are combined with each other, linear structures having arbitrary lengths can be drawn in the x-direction on the substrate 1. By using the electro-optic element 32, the above operations can be performed in the y-direction on the substrate 1. For this reason, the electro-optic elements 31 and 32 are controlled, an atomic structure having an arbitrary two-dimensional pattern can be manufactured on the substrate 1. In addition, the node (or antinode) position control of the standing wave can be accurately reproduced by the applied voltage. For this reason, the atomic drawing position control according to the methods has good operationality and very high reliability.

An amount of deposition of atoms on the substrate 1 is determined depending on time of deposition. For this reason, when an arbitrary two-dimensional pattern is generated according to the present invention, the height of the atomic structure manufactured on the substrate 1 can also be controlled. More specifically, when a voltage applied to the electro-optic element relatively rapidly is changed, a thin structure can be drawn. When the voltage is slowly changed for a long period of time, a thicker structure can be drawn.

Voltages applied to the electro-optic elements 31 and 32 are supplied from the electro-optic element drive devices 33 and 34, respectively. In order to draw a desired pattern, voltages supplied from the electro-optic element drive devices 33 and 34 to the electro-optic elements 31 and 32 are controlled by control devices 35 and 36.

The electro-optic elements 31 and 32 can be used to control atomic drawing in the x-direction and the y-direction. Since the electro-optic elements 31 and 32 can be independently controlled, an arbitrary pattern can be formed on the substrate 1.

An object to which the present invention can be applied is not limited to an atom. It is apparent that the present invention can be extended to general particles on which optical dipole force acts. For example, molecules can be deposited on a substrate to have an arbitrary pattern. When laser cooling cannot be applied depending on the types of molecules, the step of collimating a particle beam by optical molasses in FIG. 2 is omitted, and a molecular beam having a divergence of 1 mrad or less is manufactured by only two pin holes. In this manner, the application of the present invention can be widened.

The case in which a collimated thermal atomic beam is used as an atom source has been described above. However, a moderated atomic beam used in a conventional laser cooling experiment or cooled atoms released from a magneto-optical trap can also be used as an atom source. In this case, a distribution of speed components of atoms perpendicular to the substrate surface is compressed to about 1/1000 the distribution in the thermal atomic beam. Therefore, a structure can be drawn at a resolution (10 nm or less) which is considerably higher than that obtained when the thermal atomic beam is used.

An atomic beam consisting of atom seeds of a single type has been described above. However, the above contents can also be performed to atoms of different types. For this purpose, thermal atomic beams emitted from a plurality of atom sources are collimated and synthesized, and then controlled in movement by optical dipole force to deposit the atoms, thereby manufacturing a desired micropattern. However, depending on atom seeds to be used, a transition frequency or the cycle of a pattern to be manufactured are considered as a whole, and a laser beam having a necessary wavelength is prepared. At this time, when the atom seeds to be used and the wavelength of the beam are appropriately selected, a plurality of optical standing waves can be formed by beams of different wavelengths, different patterns can be independently drawn for the types of atom seeds, and atoms can be uniformly deposited without drawing a pattern. For this reason, arbitrary three-dimensional patterning can be performed.

According to the present invention, a large number of atomic structures which are equal to each other and which have arbitrary patterns having a resolution (resolution which is a convergent beam diameter or less of a charged particle beam) can be simultaneously obtained.

According to the present invention, there are provided an atomic lithography apparatus and an atomic lithography method (method of manufacturing an atomic structure) in which the shape of atoms deposited on a substrate can be accurately controlled with good reproducibility by using a laser which performs phase control using an electro-optic element.

According to the present invention, there are provided an atomic lithography apparatus and an atomic lithography method (method of manufacturing an atomic structure) in which, because different atom deposition times can be realized at respective positions on the substrate 1 by using the electro-optic element, the height of atoms deposited on the substrate can be freely controlled.

According to the present invention, an aggregation manner of atom deposition on a substrate which cannot be controlled by conventional techniques can be controlled. In this manner, the function such as conductivity held by the atom deposition can be controlled.

What is claimed is:

1. An atomic lithography apparatus for depositing atoms included in an atomic beam on a substrate to manufacture atomic structure comprising:

an atomic oven having a pin hole;

a collimator having a pin hole for collimating an atom gas effused from the atomic oven to generate an atomic beam;

lasers for irradiating laser beams on the atomic beam to control the divergence of the atomic beam;

lasers for forming an optical standing wave at a part of a space in which the atomic beam is propagated to control the propagation direction of the atomic beam;

an electro-optic element for controlling the phases of the optical standing wave for controlling the propagation direction of the atomic beam to control the propagation direction of the atomic beam;

an electro-optic element drive device for controlling a voltage applied to the electro-optic element to control a refraction index of the electro-optic element; and a control device for controlling the electro-optic element drive device.

2. The atomic lithography apparatus according to claim 1, comprising a shutter for blocking the atomic beam.

3. The atomic lithography apparatus according to claim 1, wherein laser beams for controlling the propagation direction of the atomic beam are constituted by laser beams which are perpendicular to the propagation direction of the atomic beam.

4. The atomic lithography apparatus according to claim 2, wherein laser beams for controlling the propagation direction of the atomic beam are constituted by laser beams which are perpendicular to the propagation direction of the atomic beam.

5. A method of manufacturing an atomic structure on a substrate comprising:

an atomic beam generation step for generating an atomic beam; and a step for controlling an optical standing wave obtained by a laser by using an electro-optic effect to control the propagation direction of the atomic beam; wherein the propagation direction of the atomic beam is controlled by changing the phase of the optical standing wave.

6. The method of manufacturing an atomic structure on a substrate according to claim 5, wherein the atomic beam generation step includes:

an atom gas generation step for evaporating atoms in an atomic oven into atomic gas;

an atomic beam acquisition step for propagating the atomic gas through one pin hole to collimate the atomic gas; and, irradiating the laser beams on the collimated atomic gas to set the divergence of the atomic gas at not more than 1 mrad.

7. The method of manufacturing an atomic structure on a substrate according to claim 5, wherein laser beams which are orthogonal to a plane perpendicular to the propagation direction of the atomic beam are utilized; and the optical standing wave is obtained by the two laser beams passing through the electro-optic element, and, by controlling the refraction index of the electro-optic element.

8. An atomic lithography apparatus comprising:

an atomic beam generation means for generating an atomic beam consisting of gaseous atoms;

lasers for irradiating laser beams on the atomic beam generated by the atomic beam generation means to control the divergence of the atomic beam;

lasers for forming an optical standing wave at a part of a space in which the atomic beam is propagated to control the propagation direction of the atomic beam;

an electro-optic element for controlling the phases of the optical standing wave for controlling the propagation direction of the atomic beam to control the propagation direction of the atomic beam;

an electro-optic element drive device for controlling a voltage applied to the electro-optic element to control a refraction index of the electro-optic element; and a control device for controlling the electro-optic element drive device.

9. The atomic lithography apparatus according to claim 1, wherein four lasers are used for irradiating laser beams on the atomic beam to control the divergence of the atomic beam.

10. The atomic lithography apparatus according to claim 1, wherein two lasers are used for forming an optical standing wave at a space in which the atomic beam is propagated to control the propagation direction of the atomic beam.

11. The atomic lithography apparatus according to claim 3, wherein two laser beams which are perpendicular to the propagation direction of the atomic beam and orthogonally arranged are utilized.

12. The atomic lithography apparatus according to claim 4, wherein two laser beams which are perpendicular to the propagation direction of the atomic beam and orthogonally arranged are utilized.

13. The method of manufacturing an atomic structure on a substrate according to claim 7, wherein two laser beams which are orthogonal to a plane perpendicular to the propagation direction of the atomic beam are utilized.

* * * * *